US008615937B1

(12) United States Patent
Heim

(10) Patent No.: US 8,615,937 B1
(45) Date of Patent: Dec. 31, 2013

(54) DANCE FLOOR ASSEMBLY

(76) Inventor: Douglas Richard Heim, Oneida, WI (US)

( * ) Notice: Subject to any disclaimer, the term of this patent is extended or adjusted under 35 U.S.C. 154(b) by 0 days.

(21) Appl. No.: 13/593,410

(22) Filed: Aug. 23, 2012

(51) Int. Cl.
*E04B 2/00* (2006.01)

(52) U.S. Cl.
USPC ..... 52/173.1; 52/28; 52/592.1; 362/153

(58) Field of Classification Search
USPC ..... 52/173.1, 582.1, 585.1, 586.1, 590.2, 52/591.5, 592.1, 592.282, 506.01, 506.05, 52/506.09, 509, 512; 84/600, 644, 645; 362/45, 147, 153, 800
See application file for complete search history.

(56) References Cited

U.S. PATENT DOCUMENTS

| | | | | |
|---|---|---|---|---|
| 4,303,969 | A | 12/1981 | Hamilton et al. | |
| 5,070,662 | A | 12/1991 | Niese | |
| 5,095,412 | A * | 3/1992 | French | 362/153 |
| 5,589,654 | A | 12/1996 | Konwiser et al. | |
| 6,732,478 | B1 * | 5/2004 | Russell et al. | 52/28 |
| 7,549,784 | B1 * | 6/2009 | Teeters | 362/576 |
| 7,716,895 | B2 * | 5/2010 | Fairorth et al. | 52/582.2 |
| 7,753,577 | B2 * | 7/2010 | Teeters | 362/576 |
| 7,877,950 | B2 * | 2/2011 | Fairorth et al. | 52/582.2 |
| 8,128,253 | B2 * | 3/2012 | Opitz et al. | 362/153 |
| 8,516,764 | B2 * | 8/2013 | Shige et al. | 52/506.06 |
| 2009/0147504 | A1 * | 6/2009 | Teeters | 362/153 |

* cited by examiner

*Primary Examiner* — Brian Glessner
*Assistant Examiner* — Beth Stephan
(74) *Attorney, Agent, or Firm* — Steven H Greenfield; Greenfield Invention and Patent Consulting Inc.

(57) ABSTRACT

A dance floor and a method of assembly of the dance floor are disclosed. The dance floor contains a plurality of interconnecting frames, each containing intersecting elongated panels, trim panels, wiring embedded inside channels disposed on the bottom of the elongated panels that are connected to electrical connectors, electrical receptors and ribbon lights. An electrical controller produces a chase pattern where strings of adjacent light bulbs cycle on and off to give the illusion of lights moving along the string. The dance floor is manufactured of lightweight materials and is configured for easy in situ assembly, installation and disassembly.

15 Claims, 14 Drawing Sheets

DANCE FLOOR ASSEMBLY

FIELD OF THE INVENTION

The present invention relates to a dance floor and a method of assembly of the dance floor. More specifically, the dance floor of the present invention is made of a plurality of interconnecting sections each containing elongated panel members, trim panel members, wiring, lighting, a dance floor panel and attaching means for the interconnecting sections. The dance floor is made of lightweight materials and is configured for easy in situ assembly, installation and disassembly.

BACKGROUND OF THE INVENTION

The dance floor of the present invention provides lighting contained within the dance floor configured for alternating in a chase pattern and creating a suitable atmosphere for dancing. In order to produce a functional dance floor in a typically limited space, the organization and the location of the dance floor sections, the lights, the wiring and the control mechanism for cycling the on and off pattern of the lights must be optimally configured and installed.

Dance floors and portable floors disclosed in prior art references appear to be heavier and have more complex designs compared to that of the present invention.

U.S. Pat. No. 5,589,654 discloses an electronic dance floor system that consists of at least two dancing sections with each section further having at least four composite pad assemblies.

U.S. Pat. No. 5,070,662 relates to portable floors such as aerobics, sport or dance floors, formed from a plurality of interconnecting panel sections joined by a tongue and groove coupling, and more particularly to apparatus for locking a tongue and groove coupling between adjacently situated portable floor sections.

U.S. Pat. No. 4,303,969 describes a portable dance floor having a plurality of modular floor components adapted to be interconnected to form a continuous dance floor. Each of the modular floor components include a self-contained illumination circuitry which is completed upon coupling of the units.

SUMMARY OF THE PRESENT INVENTION

In the main aspect of the present invention, a dance floor assembly comprises a plurality of frame members configured for adjoining one another, wherein each frame contains: a first longitudinal panel having a top, a bottom, a midpoint, an upper end, a lower end, an outer side and an inner side; a second longitudinal panel having a top, a bottom, a midpoint, an upper end, a lower end, an outer side and an inner side, the second longitudinal panel being disposed substantially parallel in relation to the first longitudinal panel; a first transverse panel having a top, a bottom, a first segment and a second segment; the first segment of the first traverse panel having a first side and a second side, a first end and a second end, the first end of the first segment of the first transverse panel being joined with the midpoint of the first longitudinal panel, the second end of the first segment of the first traverse panel being joined with the midpoint of the second longitudinal panel; the second segment having an inner side and an outer side, a first end and a second end, the first end of the second segment of the first transverse panel being joined with the midpoint of the second longitudinal panel; a second transverse panel having a top, a bottom, a first end, a second end, a mid point, an outer side and an inner side, the first end of the second transverse panel being joined with the lower end of the first longitudinal panel, the midpoint of the second transverse panel intersecting the lower end of the second longitudinal panel; the lower end of the first longitudinal panel being unattached, the lower end of the second longitudinal panel being unattached, the second end of the second segment of the first transverse panel being unattached and the second end of the second longitudinal panel being unattached; a dance floor panel having a top surface, a bottom surface, a first side edge, a second side edge, an upper edge and a lower edge, the bottom surface of the dance floor panel being attached to the top side of the first longitudinal panel, the bottom surface of the dance floor panel also being attached to the top side of the second longitudinal panel, to the top side of the first transverse panel and to the top of the second transverse panel in a manner that the upper edge of the dance floor panel is recessed from the outer side of the second transverse panel to form a first recess and the first side edge of the dance floor panel is recessed from the outer side of the first longitudinal panel to form a second recess, the second side edge of the dance floor panel overhanging the second end of the second segment of the first transverse panel and overhanging the second end of the second transverse panel to form a first overhang, the lower edge of the dance floor panel overhanging the upper end of the first longitudinal panel and the upper end of the second longitudinal panel to form a second overhang; a first channel disposed in the bottom of the first longitudinal panel, the channel traversing from the lower end to the upper end of the first longitudinal panel; a second channel disposed in the bottom of the second longitudinal panel, the channel traversing from the lower end to the upper end of the second longitudinal panel; a third channel disposed in the first segment of the first transverse panel, the channel traversing from the first end to the second end of the first segment of the first transverse panel, the third channel being in communication with the first channel and with the second channel; at least one enlarged area disposed within the first channel and at least one enlarged area disposed within the second channel; a plurality of interconnected electrical wires traversing the first channel, the second channel and the third channel, the wires having endings at the upper end and the lower end of the first longitudinal panel and having endings at the upper end and the lower end of the first longitudinal panel, wherein a portion of the interconnected wires comprise power supplying lines; at least one electrical wire junction disposed inside at least the enlarged area disposed within the first channel and the enlarged area disposed within the second channel; a first electrical connector connecting the wire endings at the upper end of the first longitudinal panel, a second electrical connector connecting the wire endings at the upper end of the second longitudinal panel, a first electrical receptor connecting the wire endings at the lower end of the first longitudinal panel; a second electrical receptor connecting the wire endings at the lower end of the second longitudinal panel; at least one LED ribbon attached to a side of a longitudinal panel; and at least one wire connecting said LED ribbon to at least one electrical wire junction.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

The present invention relates to a multi-component dance floor configured for assembly and installation onto a surface that is preferably substantially level and even. The surface would typically be located in a room equipped with a power source; however installing the dance floor on an outdoor surface also falls within the scope of the present invention. The design of the dance floor minimizes space and material requirements while complying with all building and electrical codes.

Figure 1:
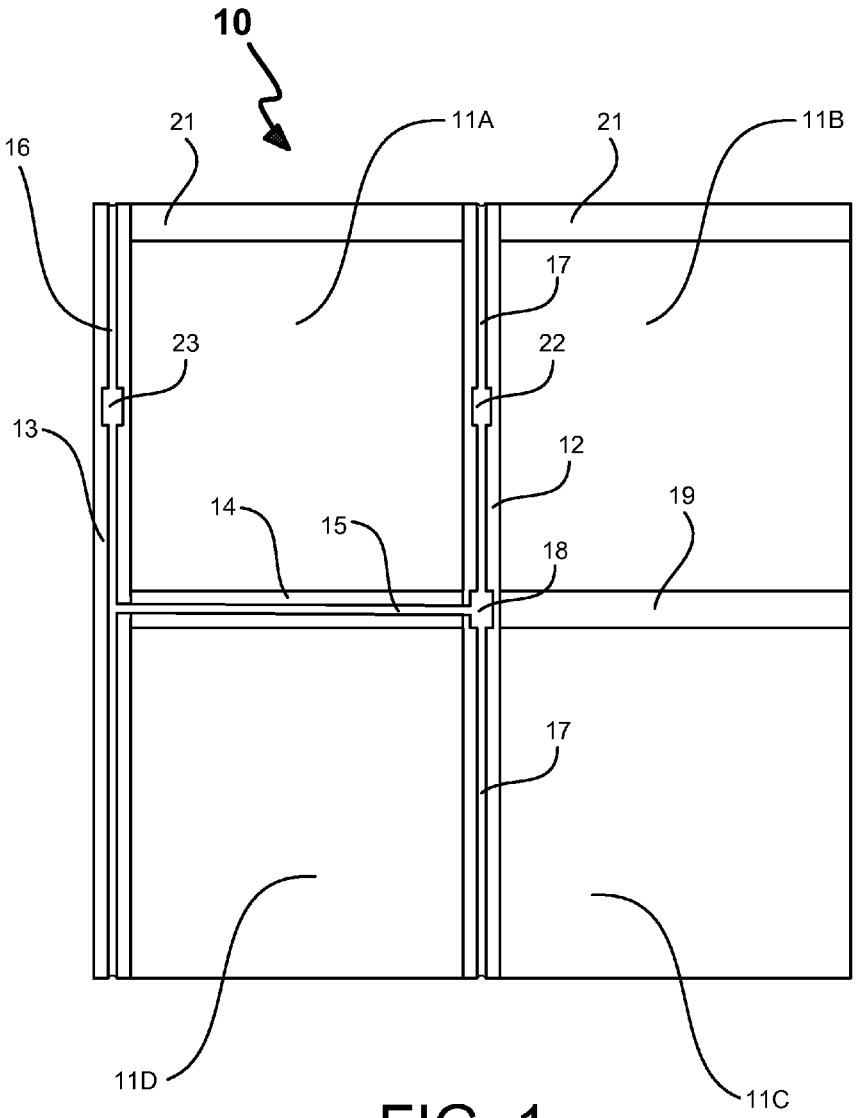
FIG. 1 is a bottom view of a frame member of a dance floor assembly according to an embodiment of the present invention.

The dance floor assembly is illustrated in FIGS. 1-14. The floor assembly is comprised of generally identical multiple frames 10. Each frame 10 is made of two elongated panels: a first elongated panel 13 and a second panel 12 disposed longitudinally and substantially parallel to one another. The longitudinal designation is arbitrary and only relates to the south to north or up and down direction of these panels in FIG. 1. Each frame 10 also comprises two elongated panels transversely disposed and in a substantially perpendicular relationship with the longitudinal panels. The first transverse panel has a first segment 14 and a second segment 19 intersects the longitudinal panels at their midpoints, while the second transverse panel 21 crosses the longitudinal panels at an upper end of the longitudinal panels 12 and 13 with the reference point being FIG. 1. It is noted that in other figures, the upper end of the frame and thus the upper end of the longitudinal panels may appear on other sides.

The four elongated panels: the two longitudinal and two transverse panels are approximately equal in length and as such, they form four square shaped quarter sections having roughly equal areas. These quarter squares are designated in the Figures as 11A, 11B, 11C and 11D. The four quarter squares combine into a larger square shape structure for the four elongated panels. A typical length for the elongated panels is 4 feet; however depending on the size of the available surface, the lengths may vary. A typical width of the elongated panels is between about 3.5 inches and 4.5 inches.

Each of the elongated panels has a flat top side on which a dance floor panel 29 is attached. The dance floor panel 29 has a bottom surface and a top surface with the bottom surface being attached to the flat side of the elongated panels. The top surface of the dance floor panel 29 is the surface that is accessible and used by the dancers. The dance floor panel 29 is made of durable Plexiglas® about ⅜ inches thick, though the thickness may vary. In the preferred embodiment of the present invention, the dance floor panel 29 has an approximately square shape of a size approximately equal to the square of the elongated panel structure. The attachment of the dance floor panel 29 to the top of the elongated panels may be accomplished by various generally known and accepted means including welding, in which the attaching surfaces are liquefied then attached substantially permanently upon drying, use of adhesives, nailing or screwing.

Figure 3:
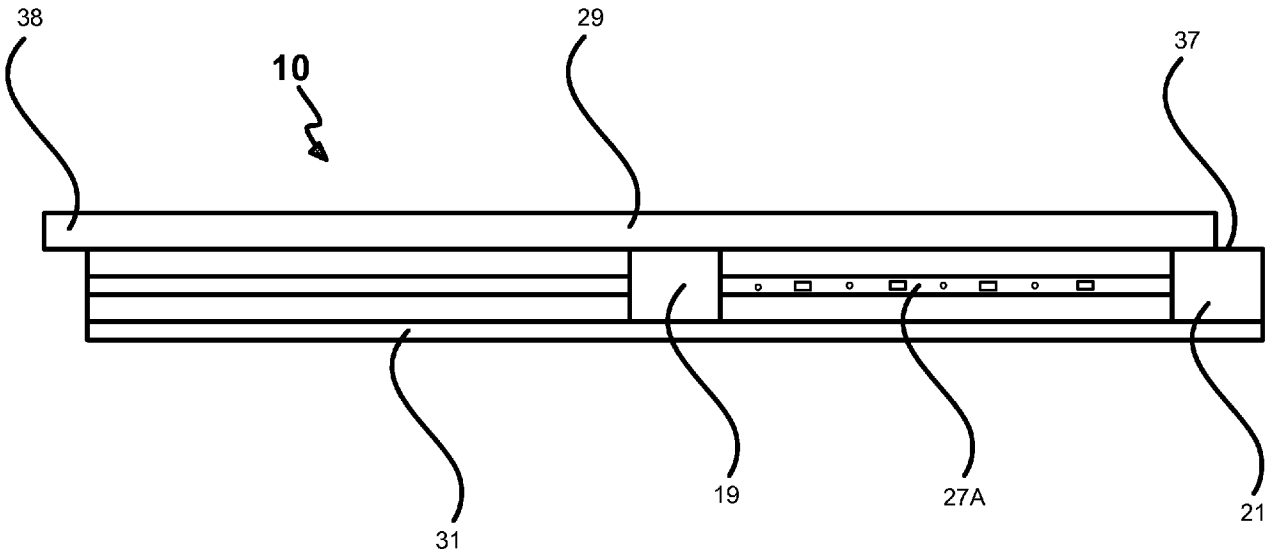
FIG. 3 is a side view of a frame member of a dance floor assembly according to an embodiment of the present invention.
Figure 4:
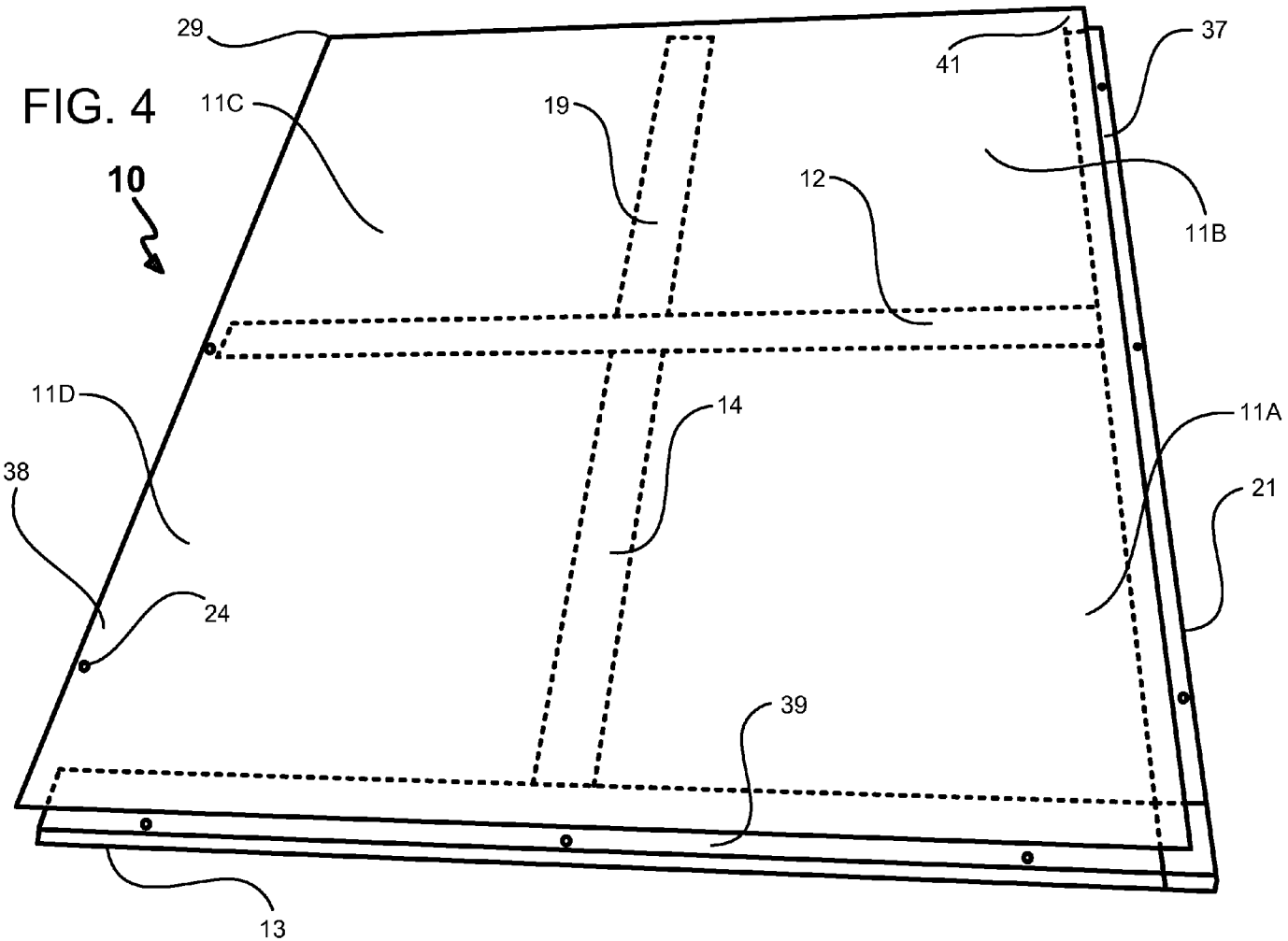
FIG. 4 shows a top perspective view of a frame component of a dance floor assembly according to an embodiment of the present invention.

The dance floor panel 29 attaches on the top of the elongated panels in such a way that one edge of the dance floor panel 29 is recessed by between 1.5 inches to about 2.5 inches from the lengthwise end of the second transverse panel 21 thereby defining a first recess 37 as indicated in FIGS. 3 and 4. The dance floor panel 29 also attaches to the elongated panels such that another edge of the dance floor panel 29 is recessed by between 1.5 inches to about 2.5 inches from the lengthwise end of the first longitudinal panel 13 defining a second recess 39.

The dance floor panel 29 overhangs the lower unattached end of second transverse panel 21 and the unattached end of the second segment 19 of the first transverse panel by between 1.5 inches to about 2.5 inches defining a first overhang 41. The dance floor panel 29 also overhangs the unattached ends of longitudinal panel 13 and longitudinal panel 12 defining the second overhang 38 as shown in FIG. 4.

The bottom sides of the longitudinal panels contain channels that traverse the length of the panels. Channel 16 traverses the first longitudinal panel 13 while channel 17 traverses the second longitudinal panel 12. The first segment 14 of the first transverse panel also contains a channel 15 that connects channels 16 and 17.

Disposed within the channels are wire junction areas that house wire junction boxes and/or wire splices and joints. A first wire junction area 18 is disposed in the center of each frame where the second longitudinal panel 12 and transverse panels 14 and 19 join a shown in FIG. 1. A second wire junction area 22 is disposed between the midpoint and upper end of the center longitudinal panel 12 while a third wire junction area 23 is disposed between the midpoint and upper end of the first longitudinal panel 13.

Figure 7:
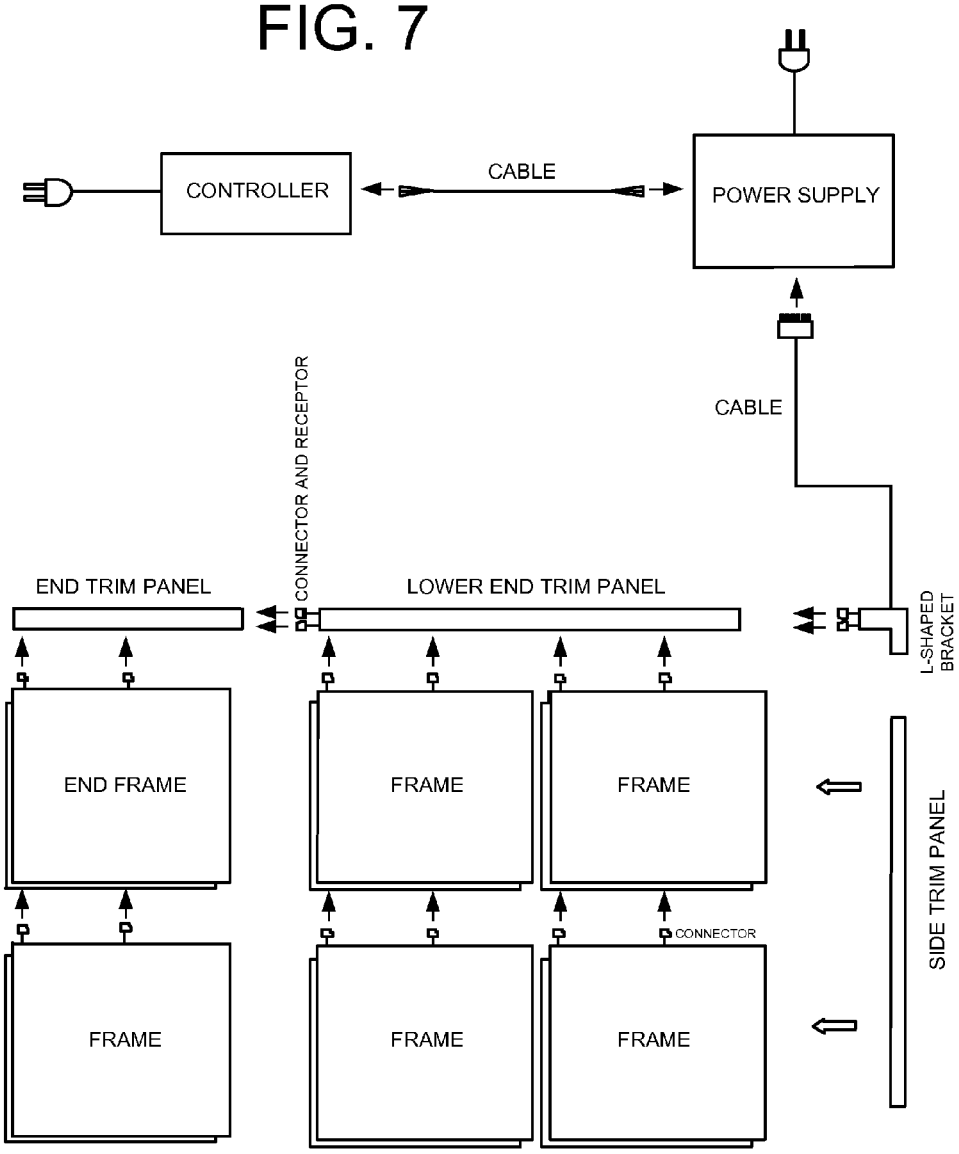
FIG. 7 is a schematic of the components of the dance floor assembly according to an embodiment of the present invention.
Figure 10:
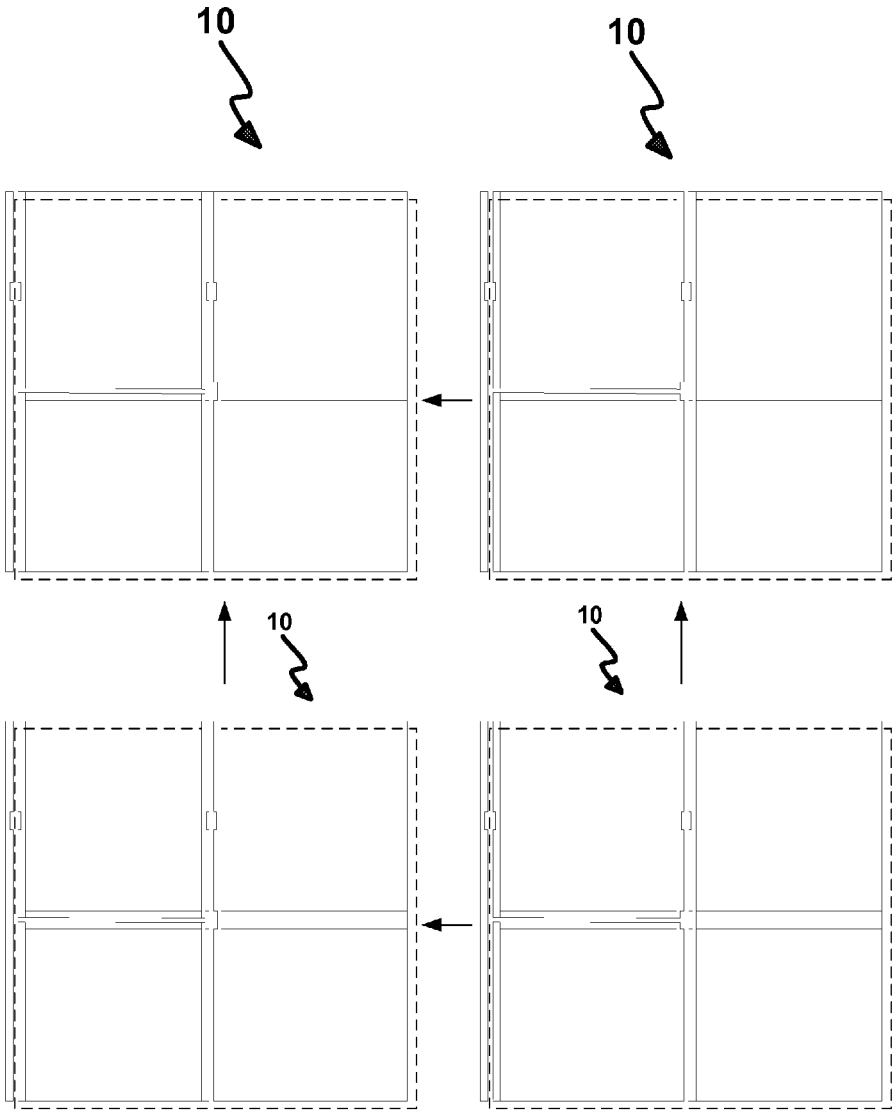
FIG. 10 portrays a method of combining the frame components of the dance floor assembly according to an embodiment of the present invention.
Figure 11:
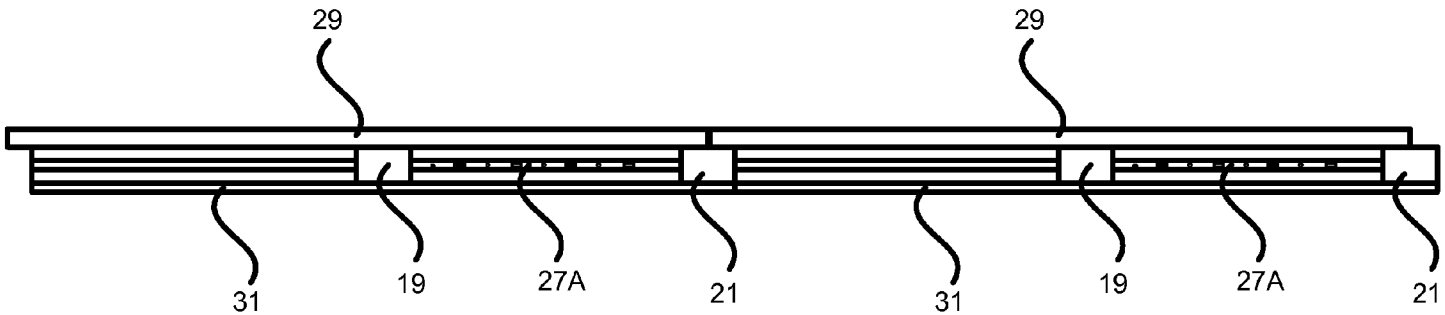
FIG. 11 is a side view of combined two frame components according to an embodiment of the present invention.

Each frame is configured for adjoining another frame in a manner illustrated in FIGS. 7, 10 and 11. Two frames 10 may be joined longitudinally by wedging exposed panel edge 37 under overhang 38. Two frames 10 may also be joined laterally by wedging exposed panel edge 39 under overhang 41. The joined frames are further tightly fixed by placing screws into holes 24 drilled through each overhang through the exposed panel edges formed by recesses 37 and 39 and wedged underneath their respective overhangs. This method of adjoining the frames allows expending the dance floor to a large area such as a full room or a portion of it as desired.

Figure 5:
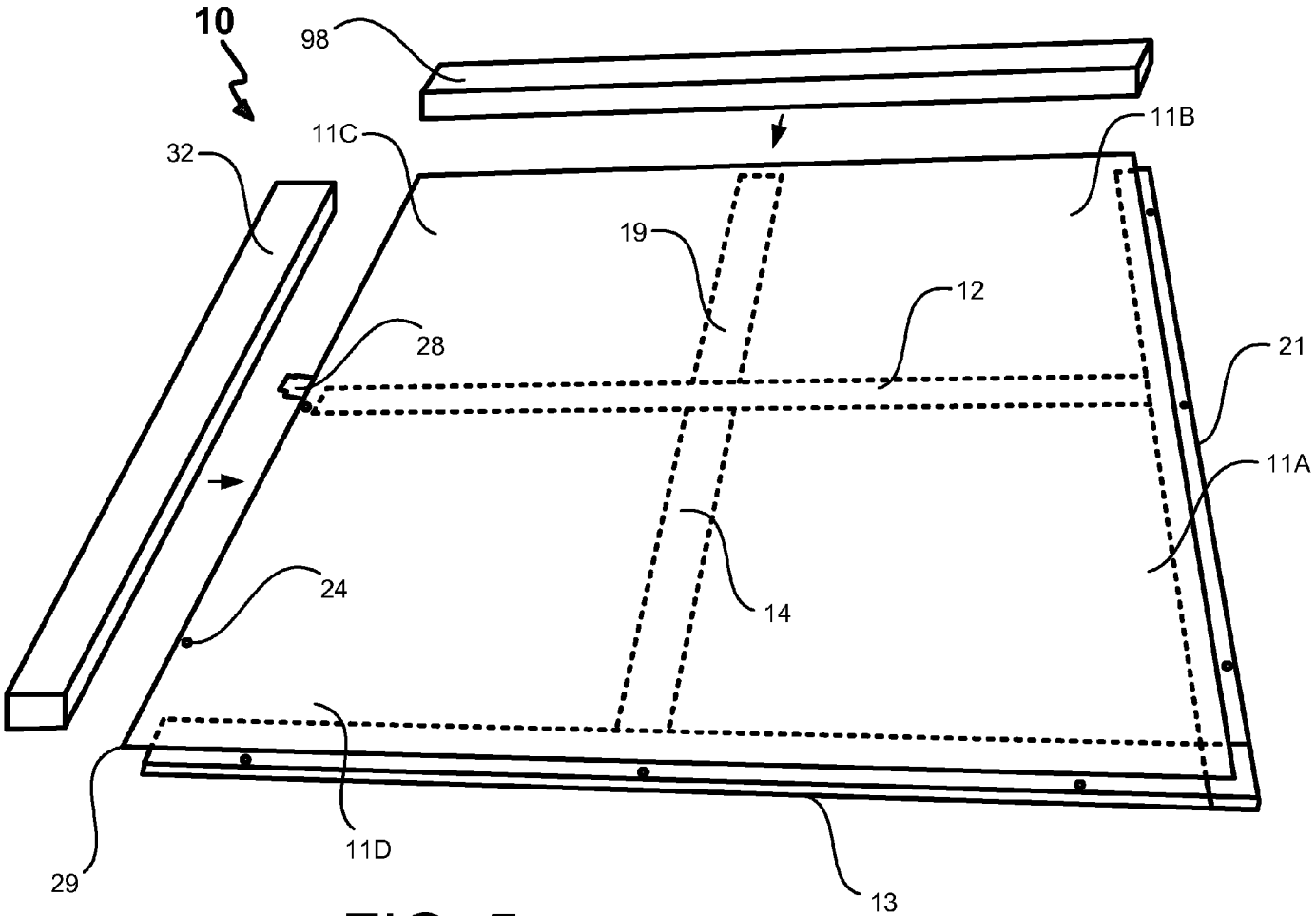
FIG. 5 is another top perspective view of a frame component of a dance floor assembly shown with detail according to an embodiment of the present invention.
Figure 8:
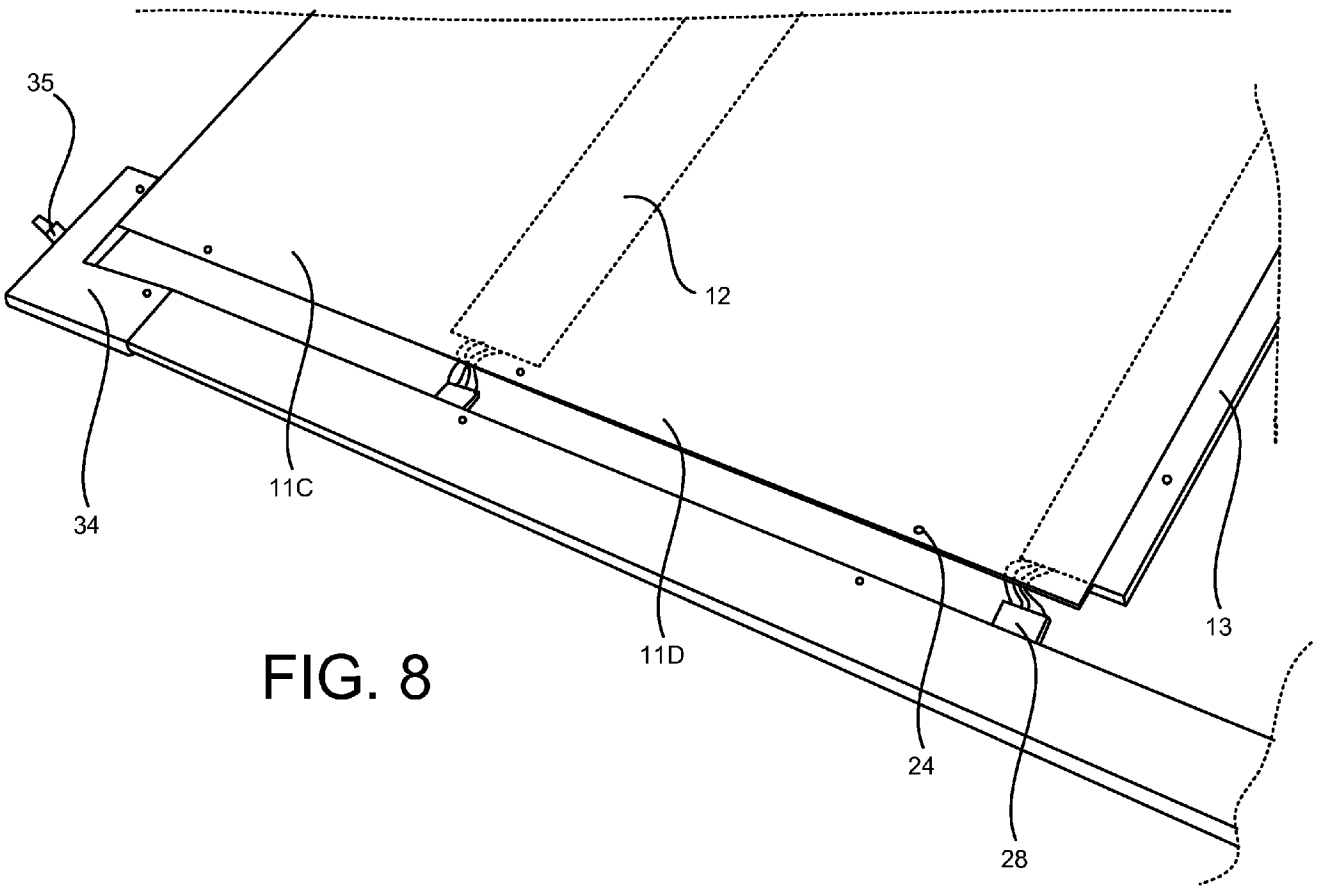
FIG. 8 is an illustration of a method of attaching a trim member, a corner bracket and a frame member of the dance floor assembly.
Figure 9:
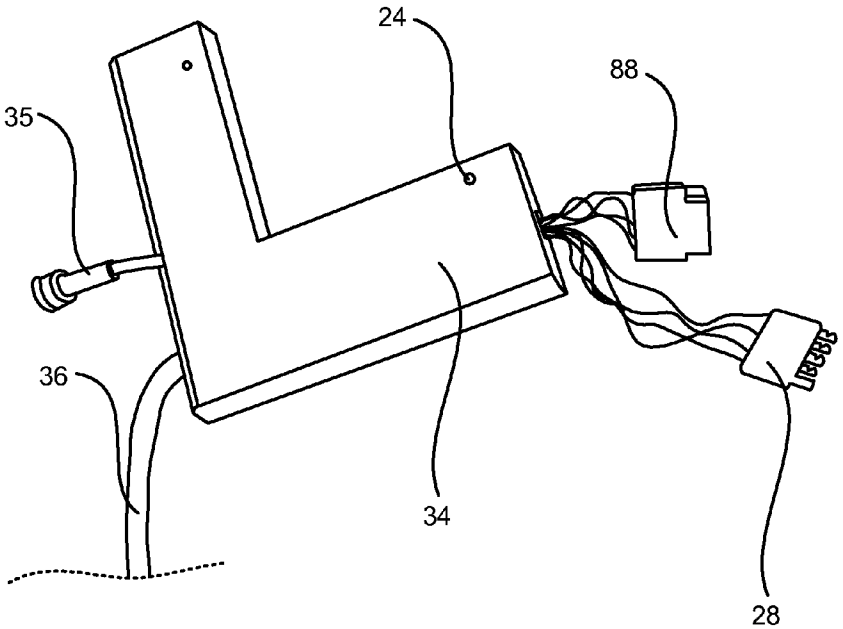
FIG. 9 is a top perspective view of a corner bracket component of the dance floor assembly according to an embodiment of the present invention.

Completing the dance floor assembly are lower end trim panels 32, side trim panels 98 and an L-shaped corner bracket 34 that seal the periphery of the dance floor. Trim panels 32 wedge lengthwise underneath the first overhang 38 while side trim panels 98 are configured to wedge underneath the second overhang 41. Trim panels 32 and 98 may come in lengths that fit one frame or multiple frames; most typically two or three. This is shown in FIGS. 5, 7 and 8. The corner bracket 34 fits in the corners of end frames 10 between the trim panels 32 and 98 that wedge under the first and second overhang lips.

Figure 6:
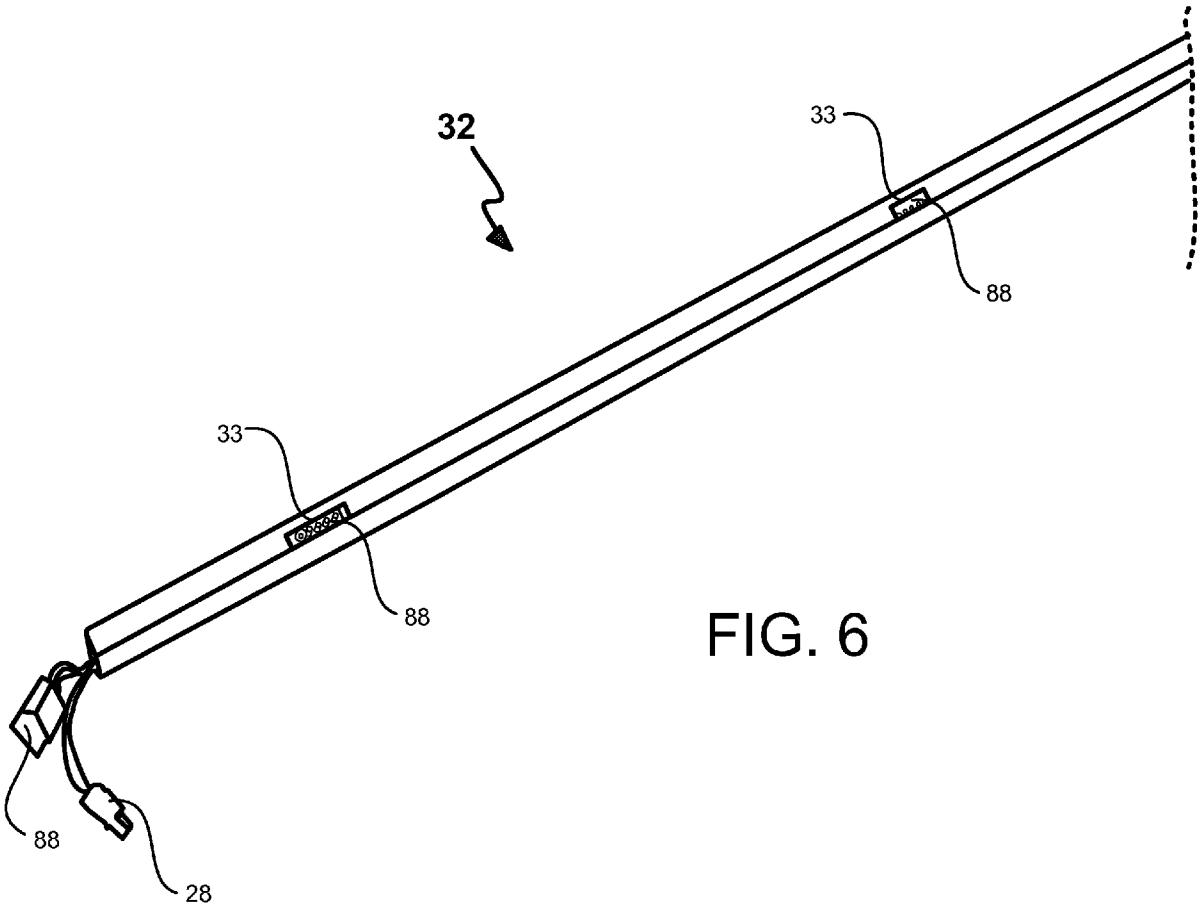
FIG. 6 is a side perspective view of a trim member of a dance floor assembly according to an embodiment of the present invention.

The ends of the wires traversing the channels 16 and 17 each contain an electrical connector 28 at the upper end 77 of the frame 10 and an electrical receptor 88 at the lower end 56. In joining two frames longitudinally, the connector of one frame plugs into a corresponding receptor of a second frame. Trim panels 32 contain embedded wires that have wire endings for attaching to receptors 88 contained in sockets 33 disposed at a side of trim panel 32 as shown in FIG. 6. Trim panels 32 also contain a connector 28 and receptor 88 at one end of the trim panel 32. These connect to a connector 28 and receptor 88 at the end trim panel joined with end frames as shown in FIG. 7. The L-shaped bracket 34 contains wires with endings connected to a connector 28 and a receptor 88. The connector 28 protruding from the L-shaped bracket 34 plugs into a receptor disposed inside the other end of the trim panel 32 and the receptor 88 protruding from the L-shaped bracket 34 plugs into a connector disposed inside the other end of the trim panel 32. Cable 36 also connects to wire endings inside the L-shaped bracket 34 and serves as a conduit to connect with the power supply and the controller as illustrated in FIG. 7. The L-shaped bracket 34 may optionally include a connector 35 for powering safety lights in the area of the dance floor. In the assembled dance floor configuration, the ribbon LEDs 27A, 27B, 27C and 27D of each frame member are connected through wires that lead to the controller and power supply unit. This enables powering all the LEDs and controlling the chase sequence for the lights.

Figure 12:
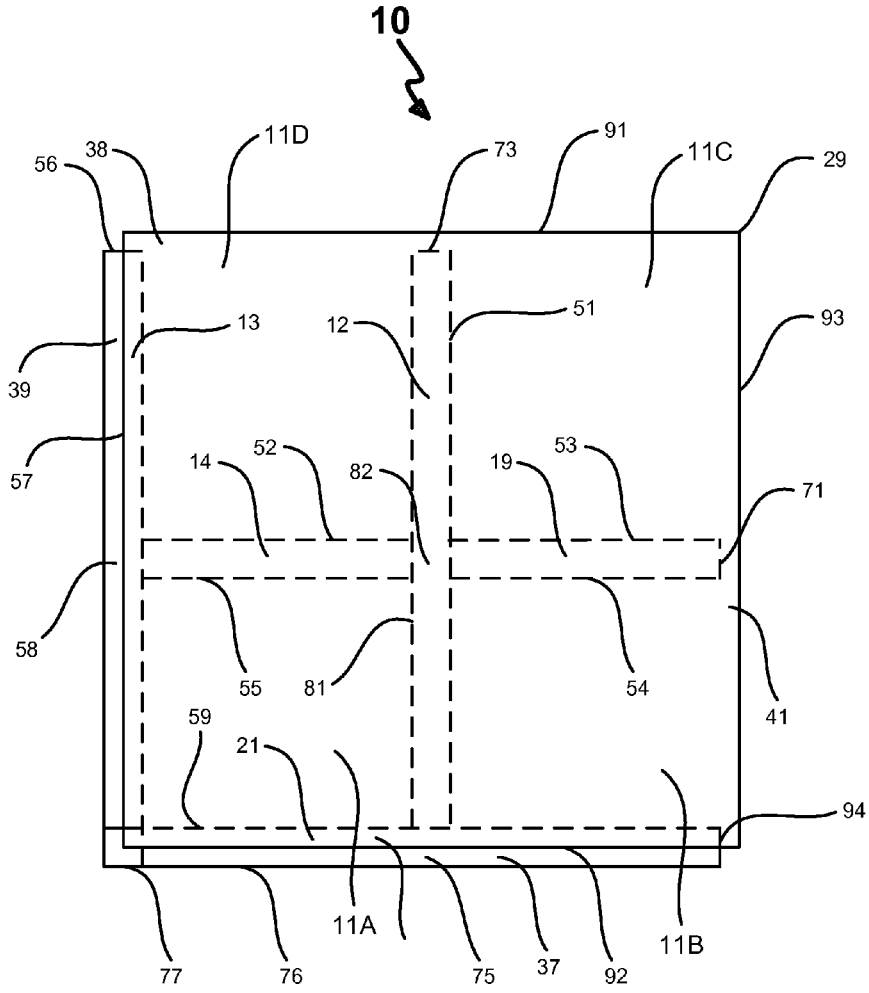
FIG. 12 is a top view of a frame member of a dance floor assembly according to an embodiment of the present invention.
Figure 13:
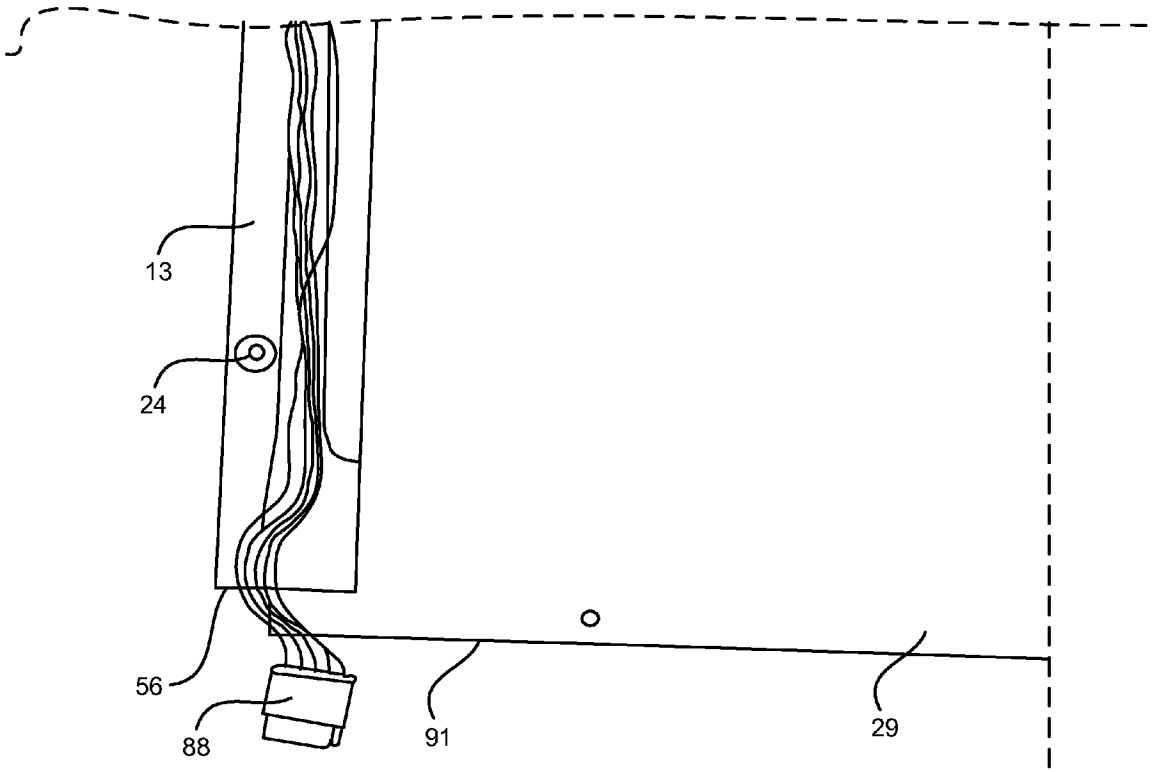
FIG. 13 is a bottom perspective view of a lower end of a frame member of a dance floor assembly shown with detail according to an embodiment of the present invention.

The lighting effect is provided by ribbon LEDs, also referred to in the art as rope lights or LED strips, disposed on the sides of the elongated panels 14, 19 and 12. In the preferred embodiment of this invention, four ribbon LEDs 27A, 27B, 27C and 27D are respectively disposed on the inner side 52 of the first segment 14 of the first transverse panel, the outer side 51 of the second longitudinal panel 12, the outer side 54 of the second segment 19 of the first transverse panel and the inner side 81 of the second longitudinal panel 12 as shown In FIG. 12. Other characteristics of the frame shown in FIG. 12 and referenced in the claims include: a first recess 37, second recess 39, first overhang 38, second overhang 41, the outer side 55 of the first segment 14 of the first transverse panel, the inner side 53 of the second segment 19 of the first transverse panel, the inner side 59 of the second transverse panel 21, the unattached end 94 of the second transverse panel 21, the unattached end 71 of the second segment 19 of the first transverse panel, the outer side 76 of the second transverse panel 21, the upper edge 92 of the dance floor panel 29, the first side edge 57 of the dance floor panel 29, the lower edge 91 of the dance floor panel 29, the second side edge 93 of the dance floor panel 29, the lower end 77 of the first longitudinal panel 13, the midpoint 58 of the first longitudinal panel 13, the unattached lower end 56 of the first longitudinal panel 13, the upper end 75 of the second longitudinal panel 12, the midpoint 82 of the second longitudinal panel 12, the lower unattached end 73 of the second longitudinal panel 12 and the inner side 81 of the second longitudinal panel 12. The connectors and receptors contain multiple prongs each receiving a wire. In the preferred embodiment of the present invention, the connectors and receptors contain five prongs are interconnected with 5 wires.

Figure 2:
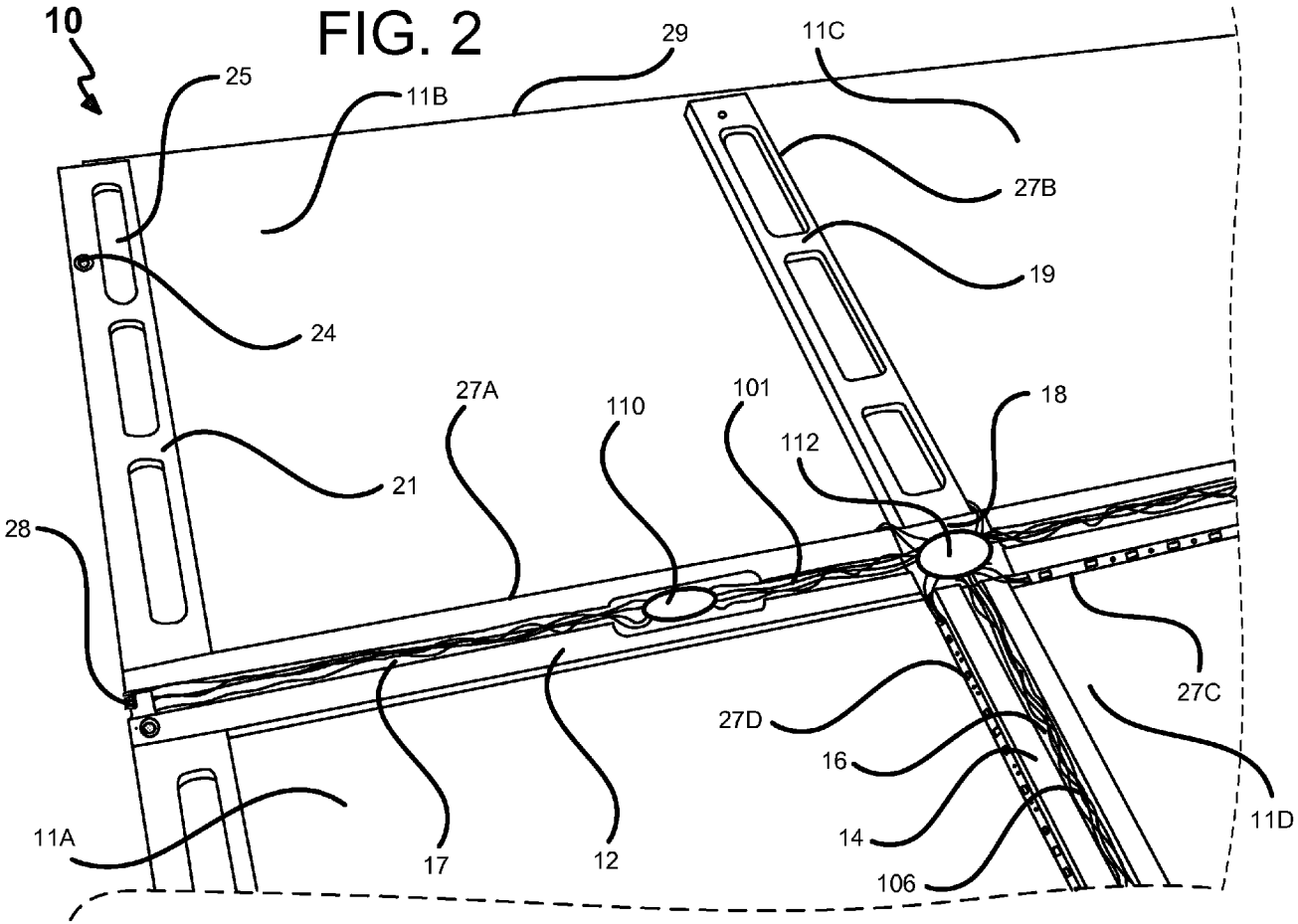
FIG. 2 is a bottom perspective view of a frame member of a dance floor assembly shown with detail according to an embodiment of the present invention.
Figure 14:
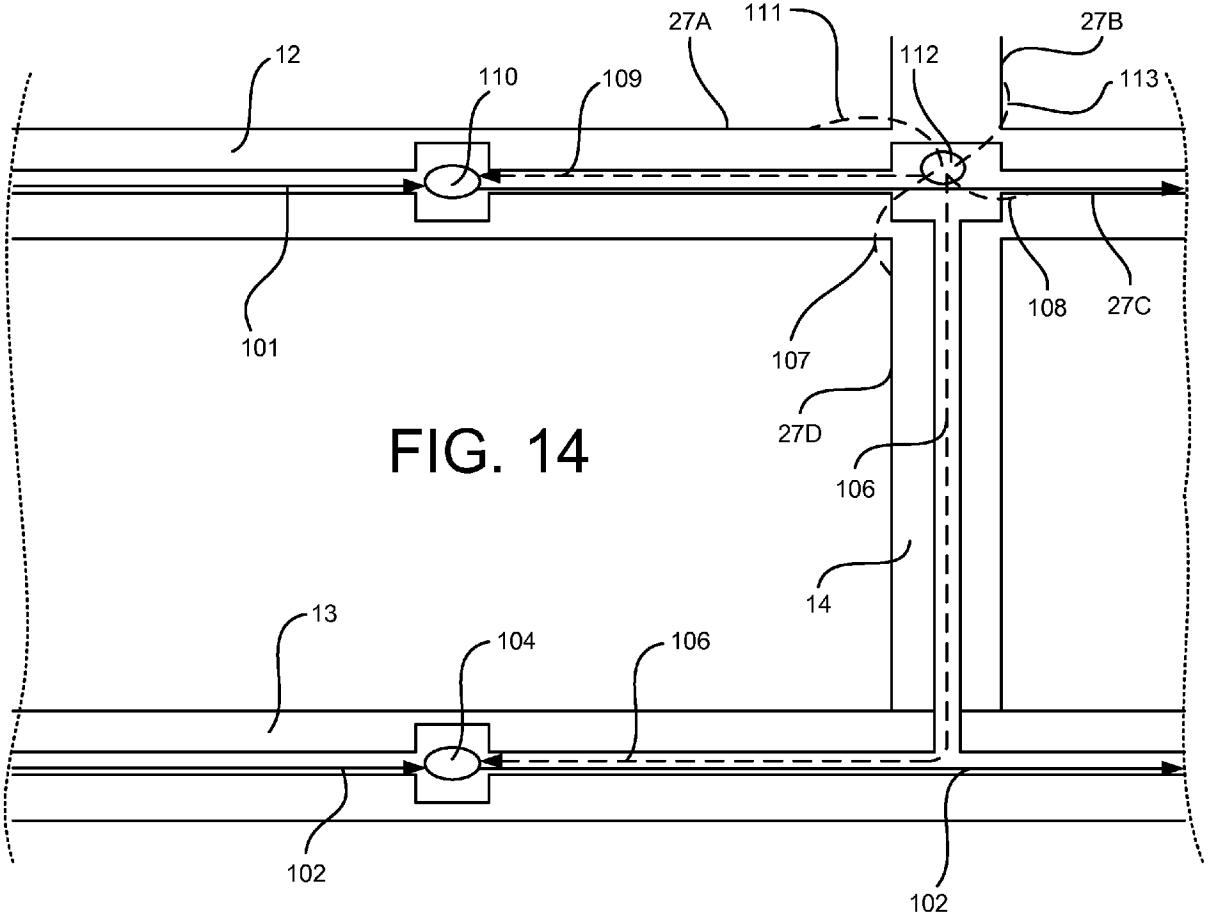
FIG. 14 is a bottom cross sectional view of a frame member highlighting the electrical wire configuration of the dance floor assembly.

FIG. 14 shows a schematic of the wiring architecture that powers and controls the four LED strips 27. Power lines 101 and 102 generally consisting of appropriate wires traverse the channels inside longitudinal panels 12 and 13 respectively passing through electrical wire junctions 110 and 104. The wires exiting the ends of LED strips 27A, 27B, 27C and 27D combine into electrical wire junction 112. A line 109 from electrical wire junction 112 is wired into electrical wire junction 110. This is also shown in FIG. 2. Another line 106 traverses the channel in transverse panel 14 into the channel in longitudinal panel 13 and is wired into electrical wire junction 104. Thus power is transmitted through lines 109 and 106 into electrical wire junction 112 from where it is distributed into the LED strips 27A, 27B, 27C and 27D.

FIG. 2 shows cutout areas 25 on the bottom sides of the elongated panels. These cutouts reduce the weight of the frames to facilitate hauling and reduce transportation costs.

The assembly is connected to a power supply and controller as shown in FIG. 7. The controller cycles the pattern of the lighting sequence that may be set in a number of different ways. A chase pattern is commonly known in the art where strings of adjacent light bulbs cycle on and off frequently to give an illusion of lights moving along the light strings. The lighting comes through a translucent Plexiglas® material to create the proper atmosphere for the dancers.

Each frame 10 further comprises a back panel 31 attached to the bottom side of the four longitudinal and transverse panels and is disposed between the longitudinal and transverse panels and the surface onto which the dance floor is installed. The attachment of the back panel 31 may be accomplished by a number of means that allow detaching the back panel as needed including screwing, nailing, or the use of adhesives. The function of the back panel 34 is to protect the wires placed in the channels.

The dimensions of each frame and the number of frames required to assemble a dance floor will vary depending on space availability. Typical frames may vary from about 3×3 feet to about 5×5 feet with the most common being 4×4 feet. The length of a trim panel 32 that seals the lower ends of a frame of combined frames may vary from about 4 feet for sealing one frame, 8 feet for sealing two combined frames and 12 feet for combining 3 combined frames. Likewise, side trim panel 98 may come in a 4 foot, 8 foot or possibly 12 foot sections.

It is noted that the combination of the frames brings the dance floor panels of the individual frames together in a manner that their edges are virtually seamless and form one large dance floor surface.

It should be understood, of course, that the foregoing relates to exemplary embodiments of the invention and that modifications may be made without departing from the spirit and scope of the invention.

I claim:

1. A dance floor assembly comprising a plurality of frame members configured for adjoining one another, wherein each frame member contains:

a first longitudinal panel having a top, a bottom, a midpoint, an upper end, a lower end, an outer side and an inner side;

a second longitudinal panel having a top, a bottom, a midpoint, an upper end, a lower end, an outer side and an inner side, said second longitudinal panel being disposed substantially parallel in relation to the first longitudinal panel;

a first transverse panel having a top, a bottom, a first segment and a second segment;

said first segment of the first traverse panel having a first side and a second side, a first end and a second end, said first end of the first segment of the first transverse panel being joined with the midpoint of the first longitudinal panel, said second end of the first segment of the first traverse panel being joined with the midpoint of the second longitudinal panel;

said second segment having an inner side and an outer side, a first end and a second end, said first end of the second segment of the first transverse panel being joined with the midpoint of the second longitudinal panel;

a second transverse panel having a top, a bottom, a first end, a second end, a mid point, an outer side and an inner side, said first end of the second transverse panel being joined with the upper end of the first longitudinal panel, said midpoint of the second transverse panel intersecting the upper end of the second longitudinal panel;

a dance floor panel having a top surface, a bottom surface, a first side edge, a second side edge, an upper edge and a lower edge, said bottom surface of the dance floor panel being attached to the top of the first longitudinal panel, said bottom surface of the dance floor panel also being attached to the top of the second longitudinal panel, to the top of the first transverse panel and to the top of the second transverse panel in a manner that the upper edge of the dance floor panel is spaced from the outer side of the second transverse panel to form a first recess and the first side edge of the dance floor panel is spaced from the outer side of the first longitudinal panel to form a second recess, said second end of the second segment of the first transverse panel and the second end of the second transverse panel being spaced from the second side edge of the dance floor panel to form a first overhang, said lower end of the first longitudinal panel and the lower end of the second longitudinal panel being spaced from the lower edge of the dance floor panel to form a second overhang;

a first channel disposed in the bottom of the first longitudinal panel, said first channel traversing from the lower end to the upper end of the first longitudinal panel;

a second channel disposed in the bottom of the second longitudinal panel, said second channel traversing from the lower end to the upper end of the second longitudinal panel;

a third channel disposed in the first segment of the first transverse panel, said third channel traversing from the first end to the second end of the first segment of the first transverse panel, said third channel being in communication with the first channel and with the second channel;

at least one enlarged area disposed within the first channel and at least one enlarged area disposed within the second channel;

a plurality of interconnected electrical wires traversing the first channel, the second channel and the third channel, said wires having endings at the upper end and the lower end of the first longitudinal panel and having endings at the upper end and the lower end of the second longitudinal panel, wherein a portion of said interconnected wires comprise power supplying lines;

at least one electrical wire junction disposed inside at least the enlarged area disposed within the first channel and the enlarged area disposed within the second channel;

a first electrical connector connecting the wire endings at the lower end of the first longitudinal panel, a second electrical connector connecting the wire endings at the lower end of the second longitudinal panel, a first electrical receptor connecting the wire endings at the upper end of the first longitudinal panel; and a second electrical receptor connecting the wire endings at the upper end of the second longitudinal panel.

2. The dance floor assembly of claim 1, wherein a first frame member of the plurality of frame members is adapted to be longitudinally adjoined with a second frame member of the plurality of frame members such that one of the overhangs of the first frame member overlays onto one of the recesses of the second frame member, and wherein said first electrical connector plugs into the first electrical receptor and the second electrical connector plugs into the second electrical receptor.

3. The dance floor assembly of claim 2, wherein the first frame member is adapted to be transversely joined with a third frame member of the plurality of frame members such that one of the overhangs of the first frame member overlays onto one of the recesses of the third frame member.

4. The dance floor assembly of claim 3, further comprising a first trim panel having a first end, a second end, an outer side and an inner side, said first trim panel being adapted for adjoining with at least one frame member wherein one of the overhangs of the frame member is configured to overlay onto the inner side of the first trim panel, said first trim panel containing embedded wires, said wires having a plurality of endings connected to one or more receptors, said receptors being accessible through an opening in the inner side of the first trim panel, wherein the first electrical connector of the frame member is configured to plug into one of the receptors of the first trim panel and the second electrical connector of the frame member is configured to plug into another receptor of the first trim panel, said first end of the first trim panel further comprising at least one receptor connected to wire endings, said receptor being accessible through an opening in the first end of the first trim panel.

5. The dance floor assembly of claim 4 further comprising at least one connector connected to wire endings, said connector being disposed at the second end of the first trim panel.

6. The dance floor assembly of claim 5, further comprising a second trim panel having an upper end and a lower end, an outer side and an inner side, said second trim panel being adapted for adjoining with one of the frame members wherein one of the overhangs of the frame member overlays onto the inner side of the second trim panel.

7. The dance floor assembly of claim 6 further comprising a corner bracket having a vertical leg and a horizontal leg, the corner bracket containing embedded wires having a plurality of wire endings, said horizontal leg having at least one connector and one receptor connected to the wire endings embedded in the corner bracket, said connector and receptor being adapted for respectively plugging into a matching connector and a matching receptor disposed at the first end of the first trim panel, said horizontal leg also containing a conduit for wiring leading to a power supply source and a controller, said vertical leg being adapted to adjoin the upper end of the second trim panel.

8. The dance floor assembly of claim 7 wherein at least one LED ribbon is attached to the side of at least one longitudinal panel and one LED ribbon is attached to at least one transverse panel.

9. The dance floor assembly of claim 8 wherein an LED ribbon is attached to the outer side of the second longitudinal panel, an LED ribbon is attached to the first side of the first segment of the first transverse panel, an LED ribbon is attached to the inner side of the second longitudinal panel and an LED ribbon is attached to the second side of the second segment of the first transverse panel, wherein each LED ribbon contains wire endings, said wire endings of all the LEDs being combined into an LED wire junction, wherein wire leads from the LED junction connect to the power supply source.

10. The dance floor assembly of claim 1 further comprising a back panel attached to the bottom of the longitudinal and transverse panels.

11. The dance floor assembly of claim 1 further comprising screws for attaching overhangs to other frames and trim panels.

12. The dance floor assembly of claim 9, wherein an enlarged area is disposed at the midpoint of the second longitudinal panel, an enlarged area is disposed between the midpoint and the upper end of the second longitudinal panel and an enlarged area is disposed between the midpoint and the upper end of the first longitudinal panel.

13. The dance floor assembly of claim 12 wherein electrical power lines originating from the power supply and controller feed into a first electrical junction disposed between the midpoint and the upper end of the first longitudinal panel, wherein electrical power lines originating from the power supply and controller feed into a second electrical junction disposed inside the enlarged area disposed at the midpoint of the second longitudinal panel, wherein wire leads from the LED junction connect to the second electrical junction and wherein wire leads from the LED junction traverse the channel disposed in the first segment of the first transverse panel and wherein the wire leads from the LED junction then turn into the channel disposed in the first longitudinal panel and connect to the first electrical junction.

14. The dance floor assembly of claim 9, wherein the LED wire junction is disposed inside the enlarged area located at the midpoint of the second longitudinal panel.

15. The dance floor assembly of claim 9, further comprising at least one wire connecting each LED ribbon to at least one electrical wire junction.

* * * * *